US011415120B2

(12) United States Patent
Liang et al.

(10) Patent No.: US 11,415,120 B2
(45) Date of Patent: Aug. 16, 2022

(54) WATERPROOF EMULSION PUMP WITH EXTERNAL SPRING

(71) Applicant: MAJESTY PACKAGING SYSTEMS LIMITED, Zhongshan (CN)

(72) Inventors: Peihui Liang, Zhongshan (CN); Maoyong Zhu, Zhongshan (CN); Yonglei Zhang, Zhongshan (CN); Jinkao Liang, Zhongshan (CN)

(73) Assignee: MAJESTY PACKAGING SYSTEMS LIMITED, Zhongshan (CN)

( * ) Notice: Subject to any disclaimer, the term of this patent is extended or adjusted under 35 U.S.C. 154(b) by 0 days.

(21) Appl. No.: 17/268,397

(22) PCT Filed: Mar. 23, 2020

(86) PCT No.: PCT/CN2020/080651
§ 371 (c)(1),
(2) Date: Feb. 12, 2021

(87) PCT Pub. No.: WO2021/051769
PCT Pub. Date: Mar. 25, 2021

(65) Prior Publication Data

US 2021/0381498 A1 Dec. 9, 2021

(30) Foreign Application Priority Data

Sep. 19, 2019 (CN) ..... 201910884599.2

(51) Int. Cl.
*F04B 23/02* (2006.01)
*B05B 11/00* (2006.01)

(52) U.S. Cl.
CPC ..... *F04B 23/023* (2013.01); *B05B 11/3059* (2013.01)

(58) Field of Classification Search
None
See application file for complete search history.

(56) References Cited

U.S. PATENT DOCUMENTS

2014/0084027 A1* 3/2014 Wang ..... F04B 9/14 222/321.9
2018/0339305 A1* 11/2018 Wang ..... B05B 11/306

FOREIGN PATENT DOCUMENTS

CN 104590694 A 5/2015
CN 104590708 A 5/2015
(Continued)

OTHER PUBLICATIONS

International Search Report dated Jun. 28, 2020 in corresponding International Application No. PCT/CN2020/080651, translated search page, 5 pages.

(Continued)

*Primary Examiner* — Peter J Bertheaud
*Assistant Examiner* — Geoffrey S Lee
(74) *Attorney, Agent, or Firm* — MH2 Technology Law Group LLP

(57) ABSTRACT

A waterproof emulsion pump with an external spring includes a pump body extending into a bottle body, a pump chamber is arranged in the pump body, a locking bottle cover is connected to the pump body, a pumping component is arranged in the pump chamber, and a locking cover is connected to the pump body; a one-way valve is arranged at a lower end of the pump chamber, an upper end of the pumping component is connected with a pressing head capable of driving the pumping component to operate, the pumping component includes an upper pump rod, a spring is arranged between the upper pump rod and the locking cover, a lower end of the upper pump rod is connected with a lower pump rod, a liquid inlet groove opening is formed in the lower pump rod.

8 Claims, 7 Drawing Sheets

(56) References Cited

FOREIGN PATENT DOCUMENTS

| | | | |
|---|---|---|---|
| CN | 204916562 | U | 12/2015 |
| CN | 105480550 | A | 4/2016 |
| CN | 209337264 | U | 9/2019 |
| CN | 110547582 | A | 12/2019 |
| KR | 100999932 | B1 | 12/2010 |
| KR | 20170105369 | A | 9/2017 |

OTHER PUBLICATIONS

Written Opinion dated Jun. 28, 2020 in corresponding International Application No. PCT/CN2020/080651, translated written opinion, 7 pages.

* cited by examiner

WATERPROOF EMULSION PUMP WITH EXTERNAL SPRING

CROSS-REFERENCE TO RELATED APPLICATIONS

This application is a national stage filing under 35 U.S.C. § 371 of international application number PCT/CN2020/080651, filed Mar. 23, 2020, pending, which claims priority to Chinese patent application No. 201910884599.2, filed Sep. 19, 2019. The contents of these applications are incorporated herein by reference in their entirety.

TECHNICAL FIELD

The present disclosure relates to a waterproof emulsion pump with an external spring.

BACKGROUND

Due to an exquisite design and a convenient use, an emulsion pump has been widely used in daily chemical and pharmaceutical industries. However, an existing emulsion pump has many parts and a complex structure, and is difficult in manufacturing and high in production cost. Moreover, a spring of a pumping component of the existing emulsion pump may directly contact with an emulsion in a pump chamber, and when the spring rusts, a liquid may be polluted, thus being unsanitary. After the existing emulsion pump is opened, impurities such as water and air may enter a pump chamber from a gap of a pump body, thus polluting the emulsion, which is unsanitary and environmentally friendly.

The present disclosure is proposed based on the above shortcomings of the existing technology.

SUMMARY

The technical problem to be solved by the present disclosure is to provide a waterproof emulsion pump with an external spring having a simple structure and a good sealing performance.

In order to address the above technical problem, the following technical solutions are used in the present disclosure: a waterproof emulsion pump with an external spring comprises a pump body extending into a bottle body, wherein a pump chamber is arranged in the pump body, a locking bottle cover capable of fixing the pump body on the bottle body is connected to the pump body, a pumping component capable of moving up and down in the pump chamber to upwardly pump out a liquid in the bottle body is arranged in the pump chamber, and a locking cover capable of preventing the pumping component from separating from the pump chamber and preventing the locking cover from separating from the pump body is connected to the pump body; a one-way valve only allowing the liquid in the bottle body to be upwardly discharged when the pumping component moves is arranged at a lower end of the pump chamber, an upper end of the pumping component is connected with a pressing head capable of driving the pumping component to operate, the pumping component comprises an upper pump rod capable of penetrating through the locking cover and having a pumping channel, a spring is arranged between the upper pump rod and the locking cover, a lower end of the upper pump rod is connected with a lower pump rod with one end capable of extending into the pumping channel, a liquid inlet groove opening capable of being communicated with the pumping channel is arranged in the lower pump rod, a piston capable of moving relative to the upper pump rod and the lower pump rod and blocking the liquid from entering the liquid inlet groove opening is sleeved on an outer side of the lower pump rod, a pushing part) capable of contacting with an upper end of the piston to push the piston to move downwardly is arranged on the upper pump rod, and a protruding part capable of contacting with a lower end of the piston to push the piston to move upwardly is arranged on the lower pump rod; and a waterproof structure is arranged between the upper pump rod and the locking cover.

According to some embodiments of the above waterproof emulsion pump with an external spring, a locking structure capable of limiting rebound of the pumping component is arranged between the upper pump rod and the locking cover, the locking structure comprises an internal thread arranged on an inside wall of the locking cover, the upper pump rod comprises an inner tube and an outer tube arranged outside the inner tube, an external thread matched with the internal thread is arranged on an outside wall of the outer tube, a lower end of the inner tube penetrates through the locking cover to be connected to the lower pump rod, and the pumping channel is located in the inner tube.

According to some embodiments of the above waterproof emulsion pump with an external spring, the waterproof structure comprises a sealing convex rib arranged on the outside wall of the outer tube and capable of abutting against the locking cover for sealing, and the sealing convex rib is located above the external thread.

According to some embodiments of the above waterproof emulsion pump with an external spring, a limit groove is arranged outside the lower pump rod, and a limit step capable of abutting against the limit groove when the lower pump rod extends into the pumping channel so as to prevent the lower pump rod from separating from the pumping channel is arranged in the pumping channel.

According to some embodiments of the above waterproof emulsion pump with an external spring, the inner tube and the outer tube are connected to form a spring accommodating groove allowing the spring to be placed.

According to some embodiments of the above waterproof emulsion pump with an external spring, an annular protrusion is arranged outside an upper end of the pump body, an annular groove allowing the annular protrusion to be clamped is arranged on the locking cover, and a guide pressing plate capable of fixing the annular protrusion in the annular groove is also arranged on the locking cover.

According to some embodiments of the above waterproof emulsion pump with an external spring, a lower end of the pump chamber is conical, the one-way valve is a pump bead arranged at the lower end of the pump chamber, and an elastic blocker capable of preventing the pump bead from being separated is arranged in the pump chamber and located above the pump bead.

According to some embodiments of the above waterproof emulsion pump with an external spring, an outer convex part capable of pressing the pump bead against the lower end of the pump chamber when the lower pump rod does not rise is arranged at a lower end of the lower pump rod.

According to some embodiments of the above waterproof emulsion pump with an external spring, a liquid guide pipe is arranged in the pump body and located below the one-way valve.

Compared with the existing technology, the waterproof emulsion pump with an external spring of the present disclosure has the following technical effects.

1. The waterproof structure is arranged between the upper pump rod and the locking cover of the present disclosure, so that external water or impurities can be prevented from entering the pump body from the gap of the pump body to pollute a material body, and thereby improving the sealing performance of the emulsion pump.

2. The spring of the present disclosure is arranged between the upper pump rod and the locking cover, and is arranged above the piston of the pump body, so that when the pumping component moves up and down to suck the emulsion into the pump chamber below the piston of the pump body, the spring may not be contaminated by the emulsion. Therefore, the structure enables the spring and the emulsion to be completely separated, thereby ensuring sanitation without polluting the emulsion.

3. The locking structure capable of limiting the rebound of the pumping component is arranged between the upper pump rod and the locking cover of the present disclosure, and when not in use, the upper pump rod may be fixed with the locking cover, thereby preventing leakage of the emulsion caused by mistakenly pressing the pressing head.

BRIEF DESCRIPTION OF THE DRAWINGS

The specific embodiments of the present disclosure are further described hereinafter with reference to the accompanying drawings, in which.

DETAILED DESCRIPTION

The technical solutions in the embodiments of the present disclosure are clearly and completely described hereinafter with reference to the accompanying drawings in the embodiments of the present disclosure.

Figure 1:
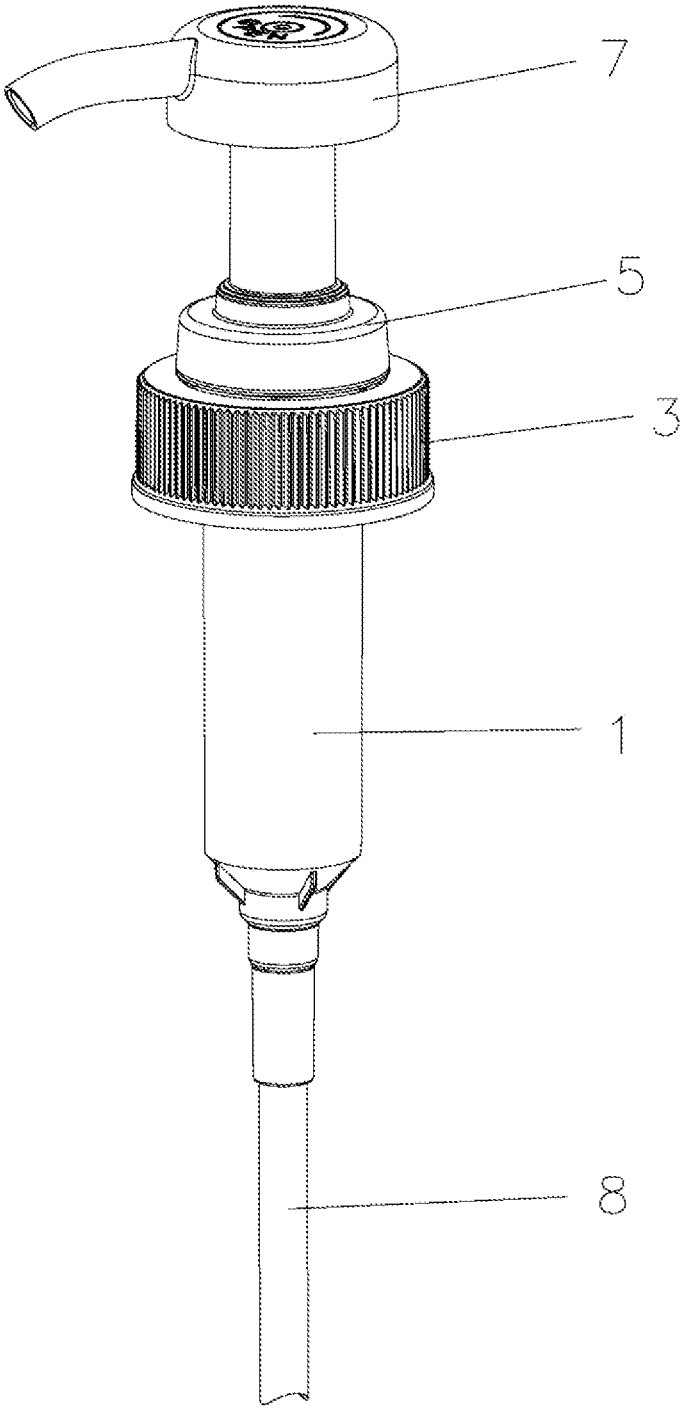
FIG. 1 is a perspective view of the present disclosure in a natural state.
Figure 2:
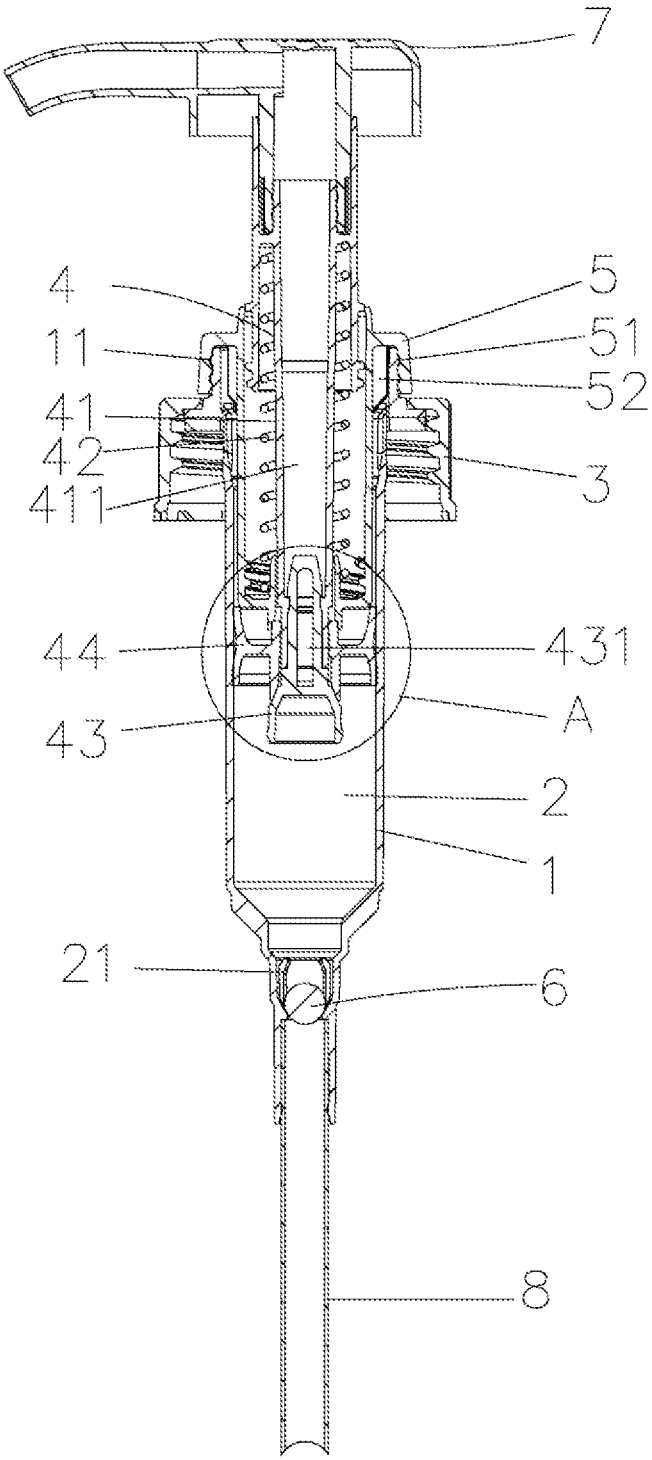
FIG. 2 is a cross-section view of the present disclosure in the natural state.
Figure 3:
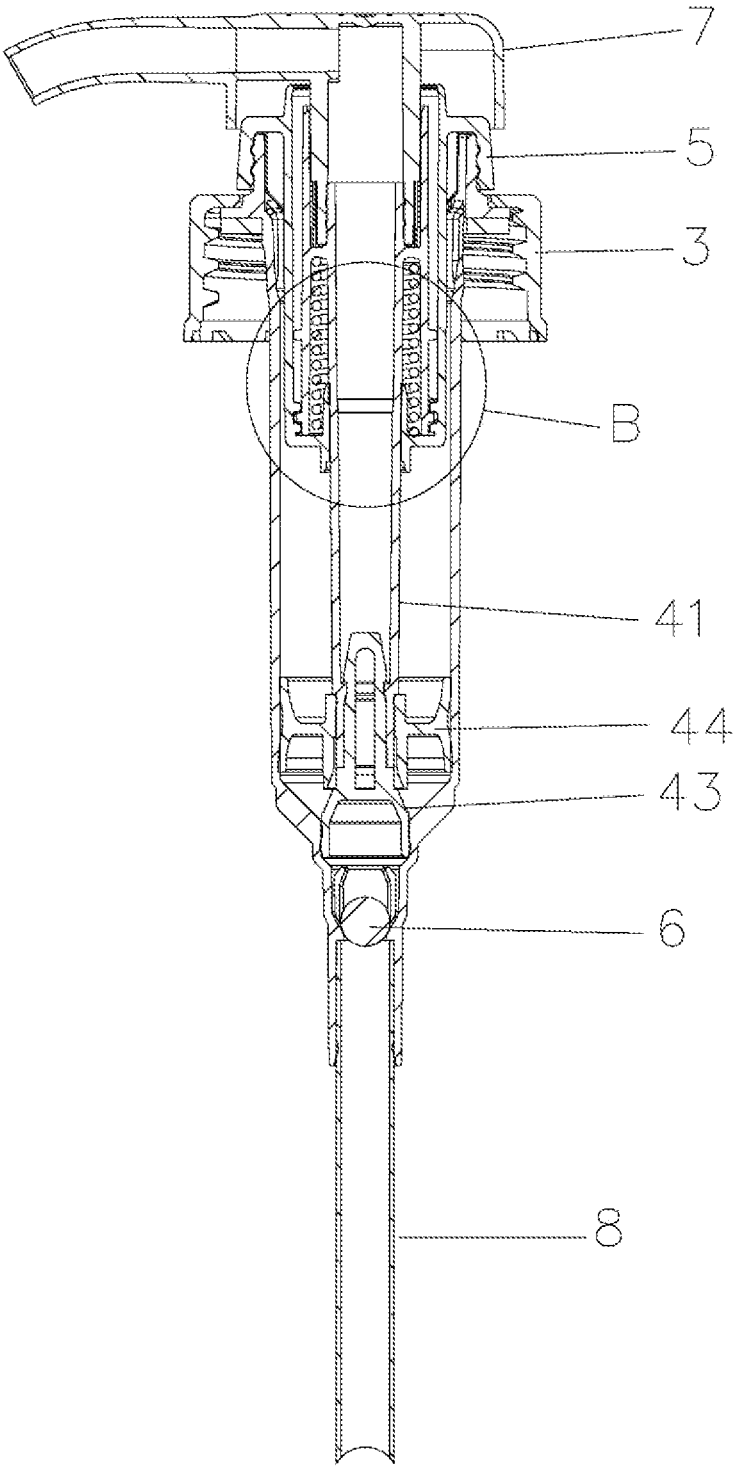
FIG. 3 is a cross-section view of the present disclosure in a pressing down state.
Figure 4:
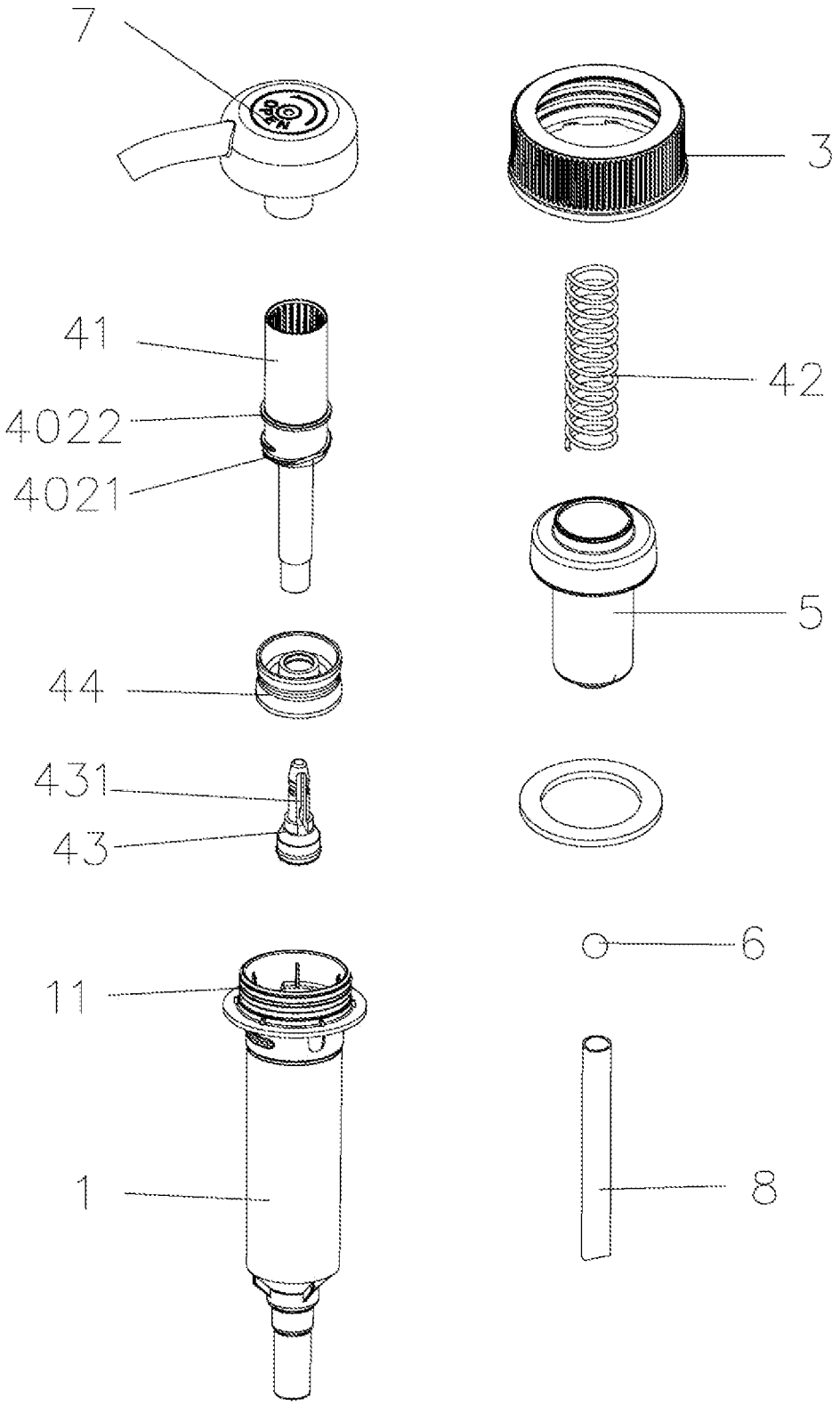
FIG. 4 is an exploded view of the present disclosure.
Figure 5:
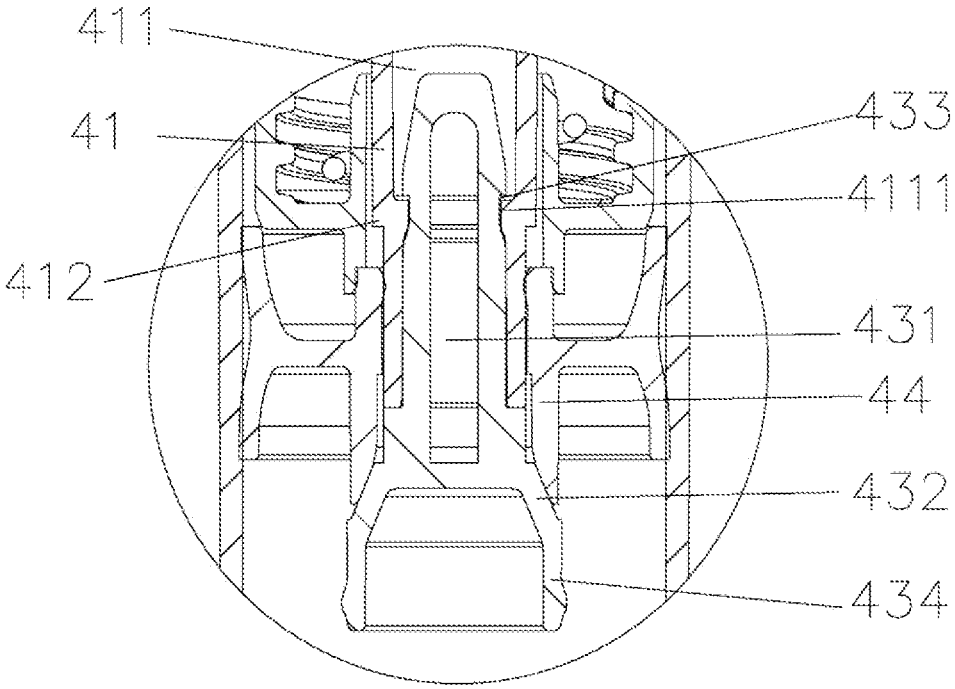
FIG. 5 is an enlarged view of a part A in FIG. 2.
Figure 6:
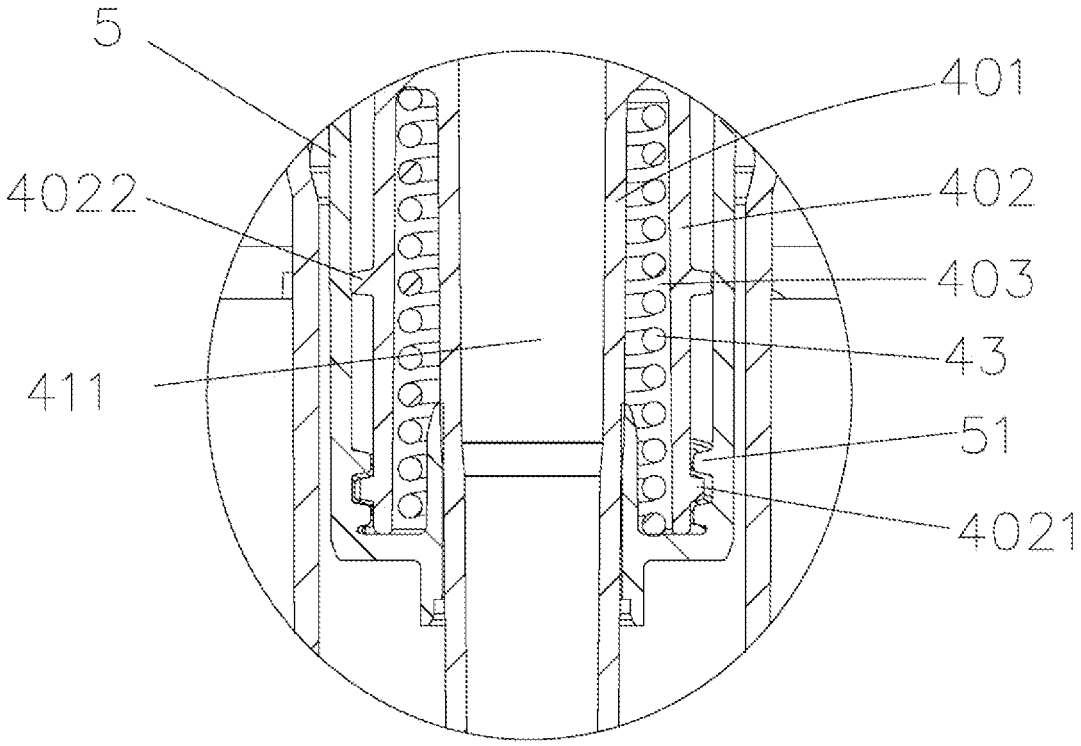
FIG. 6 is an enlarged view of a part B in FIG. 3.
Figure 7:
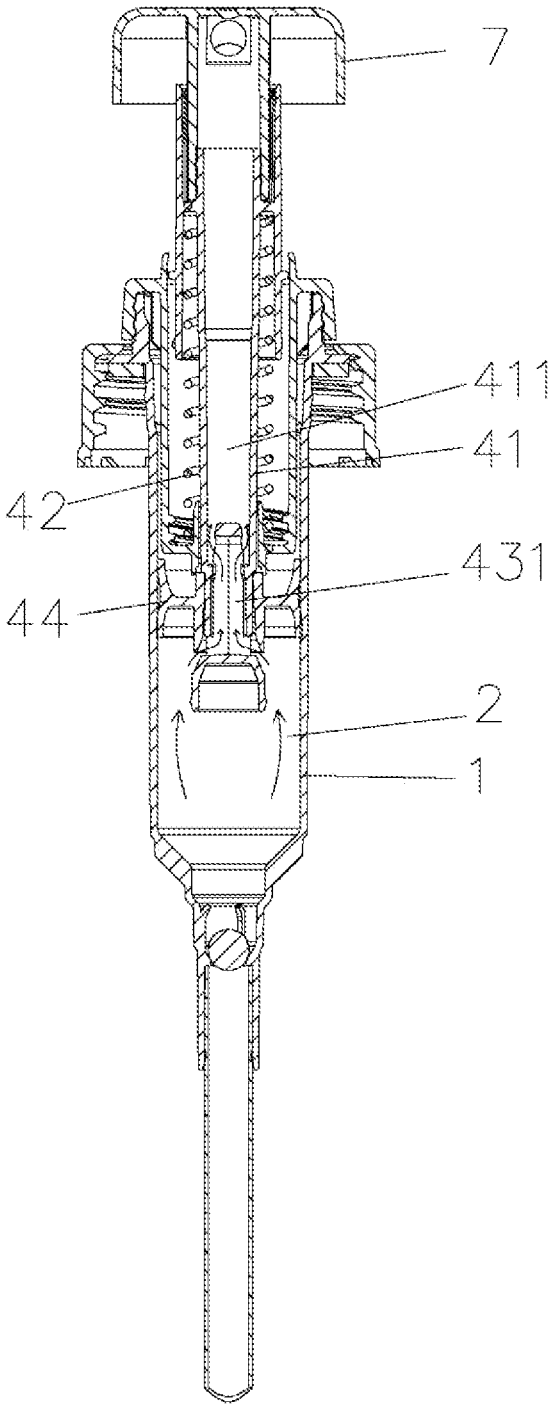
FIG. 7 is a schematic diagram showing liquid discharge of the present disclosure in a pressing down process.

As shown in FIG. 1 to FIG. 7, a waterproof emulsion pump with an external spring comprises a pump body 1 extending into a bottle body, wherein a pump chamber 2 is arranged in the pump body 1, a locking bottle cover 3 capable of fixing the pump body on the bottle body is connected to the pump body 1, a pumping component 4 capable of moving up and down in the pump chamber to upwardly pump out a liquid in the bottle body is arranged in the pump chamber 2, and a locking cover 5 capable of preventing the pumping component 4 from separating from the pump chamber 2 and preventing the locking cover from separating from the pump body 1 is connected to the pump body 1. The locking bottle cover is freely rotated by positioning the locking bottle cover through the locking cover, a one-way valve 6 only allowing the liquid in the bottle body to be upwardly discharged when the pumping component 4 moves is arranged at a lower end of the pump chamber 2, an upper end of the pumping component 4 is connected with a pressing head 7 capable of driving the pumping component 4 to operate, the pumping component 4 comprises an upper pump rod 41 capable of penetrating through the locking cover 5 and having a pumping channel 411, a spring 42 is arranged between the upper pump rod 41 and the locking cover 5, a lower end of the upper pump rod 41 is connected with a lower pump rod 43 with one end capable of extending into the pumping channel 411, a liquid inlet groove opening 431 capable of being communicated with the pumping channel 411 is arranged in the lower pump rod 43, and in an assembly process of the lower pump rod and the upper pump rod, the lower pump rod may be elastically deformed inwardly according to the liquid inlet groove opening, so that assembly is convenient. A piston 44 capable of moving relative to the upper pump rod 41 and the lower pump rod 43 and blocking the liquid from entering the liquid inlet groove opening 431 is sleeved on an outer side of the lower pump rod 43, a pushing part 412 capable of contacting with an upper end of the piston 44 to push the piston 44 to move downwardly is arranged on the upper pump rod 41, and a protruding part 432 capable of contacting with a lower end of the piston 43 to push the piston 43 to move upwardly is arranged on the lower pump rod 43. In a natural state, the spring pushes up the pump rod, and at the moment, a sealing lip on the piston contacts with a protruding part of the lower pump rod to block the pumping channel and pump chamber. When the liquid needs to be pumped, the pressing head is pressed down, the lower pump rod moves downwardly, and the spring is compressed. When the lower pump rod descends, the sealing lip on the piston is immediately separated from the protruding part of the lower pump rod, and at the moment, the pumping channel is communicated with the pump chamber below the piston. When the upper pump rod descends by a certain distance, the pushing part of the upper pump rod touches the piston and pushes the piston to move downwardly, the piston moves downwardly so as to discharge air or liquid in the pump chamber below the piston through the pumping channel, then the pressing head is released, and the spring is stretched. The upper pump rod rises by a certain distance, the protruding part of the lower pump rod contacts with the sealing lip of the piston to block the pump chamber and the pumping channel, the upper pump rod pushes the piston to rise the lower pump rod clamped with the upper pump rod in a continuous rise process, and at the moment, an air pressure between the piston and the one-way valve is less than that in the bottle. The liquid in the bottle pushes and opens the one-way valve and enters the pump chamber, thus repeatedly pressing the pressing head to discharge the emulsion in the bottle for use, so that an operation is simple. Theoretically, the certain distance above is greater than 0, with a purpose that descent or rise of the piston is delayed compared with that of the upper pump rod, so as to control connection and disconnection between the pumping channel and the pump chamber. Generally, the distance is set as 0.5 mm to 2 mm, and since a size of the open liquid outlet channel depends on the distance, a selection may be made according to a particle size of a solution. A waterproof structure is arranged between the upper pump rod 41 and the locking cover 5. The waterproof structure of the present disclosure may prevent external water or impurities from entering the pump body from a gap of the pump body to pollute a material body, and thereby improving the sealing performance of the emulsion pump.

As shown in FIG. 1 to FIG. 7, in the embodiment, a locking structure capable of limiting rebound of the pumping component 4 is arranged between the upper pump rod 41 and the locking cover 5, the locking structure comprises an internal thread 51 arranged on an inside wall of the locking cover 5, the upper pump rod 41 comprises an inner tube 401 and an outer tube 402 arranged outside the inner tube 401, an external thread 4021 matched with the internal thread 51 is arranged on an outside wall of the outer tube 402, a lower end of the inner tube 401 penetrates through the locking cover 5 to be connected to the lower pump rod 43, and the pumping channel 411 is located in the inner tube 401. The upper pump rod is pressed first, and then the external thread on the upper pump rod is matched and connected with the internal thread on the inside wall of the locking cover by rotating the upper pump rod, so as to limit the rebound of the upper pump rod, and lock the upper pump rod with the locking cover, thereby preventing leakage of the emulsion caused by mistakenly pressing the pressing head.

As shown in FIG. 1 to FIG. 7, in the embodiment, the waterproof structure comprises a sealing convex rib 4022 arranged on the outside wall of the outer tube 402 and capable of abutting against the locking cover 5 for sealing, and the sealing convex rib 4022 is located above the external thread 4021. When the upper pump rod moves up and down in the locking cover, the sealing convex rib 4022 on the outside wall of the outer tube is always pressed and sealed with the inner wall of the locking cover, thus preventing external water or impurities from entering the pump body to pollute the material body.

As shown in FIG. 1 to FIG. 7, in the embodiment, a limit groove 433 is arranged outside the lower pump rod 43, and a limit step 4111 capable of abutting against the limit groove 433 when the lower pump rod 43 extends into the pumping channel 411 so as to prevent the lower pump rod 43 from separating from the pumping channel 411 is arranged in the pumping channel 411. A stability of connection between the lower pump rod and the upper pump rod is enhanced.

As shown in FIG. 1 to FIG. 7, in the embodiment, the inner tube 401 and the outer tube 402 are connected to form a spring accommodating groove 403 allowing the spring 42 to be placed, so as to prevent the spring from falling off and position the spring.

As shown in FIG. 1 to FIG. 7, in the embodiment, an annular protrusion 11 is arranged outside an upper end of the pump body 1, an annular groove 51 allowing the annular protrusion 11 to be clamped is arranged on the locking cover 5, and a guide pressing plate 52 capable of fixing the annular protrusion 11 in the annular groove 51 is also arranged on the locking cover 5. The annular protrusion is fixed in the annular groove by pressing the guide pressing plate of the locking cover in place during assembly, so that assembly is convenient and reliable.

As shown in FIG. 1 to FIG. 7, in the embodiment, a lower end of the pump chamber 2 is conical, the one-way valve 6 is a pump bead arranged at the lower end of the pump chamber 2, and an elastic blocker 21 capable of preventing the pump bead from being separated is arranged in the pump chamber 2 and located above the pump bead.

As shown in FIG. 1 to FIG. 7, in the embodiment, an outer convex part 434 capable of pressing the pump bead against the lower end of the pump chamber 2 when the lower pump rod does not rise is arranged at a lower end of the lower pump rod 43. Leakage of the liquid is prevented during transportation.

As shown in FIG. 1 to FIG. 7, in the embodiment, a liquid guide pipe 8 is also arranged on the pump body 1 and located below the one-way valve 6.

When in use, the pressing head 7 is rotated first so as to separate the upper pump rod from the locking cover, the pumping component 4 moves upwardly under an action of an elastic force of the spring, at the moment, the pressing head 7 is pressed down for the first time, and the pumping component moves downwardly along with the pressing head 7. The piston 44 presses air in the pump chamber 2 into the pumping channel 411 from the liquid inlet groove 431 and discharges the air, and at the moment, the pump chamber 2 is in a negative pressure state. After releasing of a hand, the pumping component 4 moves upwardly under an elastic force of the spring 42. Since a pressure in the pump chamber 2 is less than that in the bottle, at the moment, the one-way valve 6 is open, and the emulsion in the bottle enters the pump chamber 2. When an air pressure in the pump chamber is equal to that in the bottle, the one-way valve 6 is closed, and the pressing head 7 is pressed again, so that the piston 44 moves downwardly to squeeze the pump chamber 2. At the moment, the emulsion enters the pumping channel 411 from the liquid inlet groove 431 and then flows out from the pressing head.

What is claimed is:

1. A waterproof emulsion pump with an external spring, comprising:

a pump body extending into a bottle body, wherein a pump chamber is arranged in the pump body, a locking bottle cover capable of fixing the pump body on the bottle body is connected to the pump body, a pumping component capable of moving up and down in the pump chamber to upwardly pump out a liquid in the bottle body is arranged in the pump chamber, and a locking cover capable of preventing the pumping component from separating from the pump chamber and preventing the locking cover from separating from the pump body is connected to the pump body;

wherein a one-way valve only allowing the liquid in the bottle body to be upwardly discharged in response to the pumping component moving is arranged at a lower end of the pump chamber, an upper end of the pumping component is connected with a pressing head capable of driving the pumping component to operate, the pumping component comprises an upper pump rod capable of penetrating through the locking cover and having a pumping channel, the external spring is arranged between the upper pump rod and the locking cover, a lower end of the upper pump rod is connected with a lower pump rod with one end capable of extending into the pumping channel, a liquid inlet groove opening capable of being communicated with the pumping channel is arranged in the lower pump rod, a piston capable of moving relative to the upper pump rod and the lower pump rod and blocking the liquid from entering the liquid inlet groove opening is sleeved on an outer side of the lower pump rod, a pushing part capable of contacting with an upper end of the piston to push the piston to move downwardly is arranged on the upper pump rod, and a protruding part capable of contacting with a lower end of the piston to push the piston to move upwardly is arranged on the lower pump rod;

wherein a waterproof structure is arranged between the upper pump rod and the locking cover; and wherein the waterproof structure comprises a sealing convex rib arranged on the outside wall of the outer tube and capable of abutting against the locking cover for sealing, and the sealing convex rib is located above the external thread and protruded from an outer surface of the upper pump rod.

2. The waterproof emulsion pump of claim 1, wherein a locking structure capable of limiting rebound of the pumping component is arranged between the upper pump rod and the locking cover, the locking structure comprises an internal thread arranged on an inside wall of the locking cover, the upper pump rod comprises an inner tube and an outer tube arranged outside the inner tube, an external thread matched with the internal thread is arranged on an outside wall of the outer tube, a lower end of the inner tube is configured to penetrate through the locking cover to be connected with the lower pump rod, and the pumping channel is located in the inner tube.

3. The waterproof emulsion pump of claim 2, wherein the inner tube and the outer tube are connected to form a spring accommodating groove for placing the external spring.

4. The waterproof emulsion pump of claim 1, wherein a limit groove is arranged outside the lower pump rod, and a limit step capable of abutting against the limit groove when the lower pump rod extends into the pumping channel so as to prevent the lower pump rod from separating from the pumping channel is arranged in the pumping channel.

5. The waterproof emulsion pump of claim 1, wherein an annular protrusion is arranged outside an upper end of the pump body, an annular groove allowing the annular protrusion to be clamped is arranged on the locking cover, and a guide pressing plate capable of fixing the annular protrusion in the annular groove is arranged on the locking cover.

6. The waterproof emulsion pump of claim 1, wherein a lower end of the pump chamber is conical, the one-way valve is a pump bead arranged at the lower end of the pump chamber, and an elastic blocker capable of preventing the pump bead from being separated is arranged in the pump chamber and located above the pump bead.

7. The waterproof emulsion pump of claim 6, wherein an outer convex part capable of pressing the pump bead against the lower end of the pump chamber in response to the lower pump rod not rising is arranged at a lower end of the lower pump rod.

8. The waterproof emulsion pump of claim 1, wherein a liquid guide pipe is arranged in the pump body and located below the one-way valve.

* * * * *